US008921295B2

(12) United States Patent
Kneipp et al.

(10) Patent No.: US 8,921,295 B2
(45) Date of Patent: Dec. 30, 2014

(54) BIODEGRADABLE CONCENTRATED NEUTRAL DETERGENT COMPOSITION

(75) Inventors: Ann Maria Kneipp, Saint Louis, MO (US); Nancy-Hope E. Kaiser, Pontoon Beach, IL (US); Althea Noel Johnson, Florissant, MO (US)

(73) Assignee: American Sterilizer Company, Mentor, OH (US)

( * ) Notice: Subject to any disclaimer, the term of this patent is extended or adjusted under 35 U.S.C. 154(b) by 14 days.

(21) Appl. No.: 13/135,218

(22) Filed: Jun. 29, 2011

(65) Prior Publication Data

US 2012/0021963 A1 Jan. 26, 2012

Related U.S. Application Data

(60) Provisional application No. 61/400,175, filed on Jul. 23, 2010.

(51) Int. Cl.

| | |
|---|---|
| ***C11D 1/72*** | (2006.01) |
| ***C11D 1/75*** | (2006.01) |
| ***C11D 3/30*** | (2006.01) |
| ***C11D 3/33*** | (2006.01) |
| ***C23G 1/24*** | (2006.01) |
| ***C11D 3/26*** | (2006.01) |
| ***C11D 1/722*** | (2006.01) |
| ***C11D 3/20*** | (2006.01) |
| ***C11D 3/28*** | (2006.01) |
| ***C23G 1/26*** | (2006.01) |
| ***C11D 3/00*** | (2006.01) |
| ***C11D 3/36*** | (2006.01) |

(52) U.S. Cl.

CPC .. *C23G 1/24* (2013.01); *C11D 1/75* (2013.01); *C11D 3/26* (2013.01); *C11D 1/72* (2013.01); *C11D 1/722* (2013.01); *C11D 3/20* (2013.01); *C11D 3/28* (2013.01); *C11D 3/2075* (2013.01); *C11D 1/721* (2013.01); *C23G 1/26* (2013.01); *C11D 3/0073* (2013.01); *C11D 3/33* (2013.01); *C11D 3/364* (2013.01)

USPC ..... 510/161; 510/245; 510/255; 510/258; 510/264; 510/265; 510/421; 510/422; 510/434; 510/470; 510/480; 510/488; 510/499; 510/500; 510/503

(58) Field of Classification Search

CPC ..... C11D 1/72; C11D 1/721; C11D 1/722; C11D 1/75; C11D 3/2075; C11D 3/26; C11D 3/28; C11D 3/20

USPC ..... 510/161, 245, 255, 258, 264, 265, 421, 510/422, 434, 470, 477, 480, 488, 499, 500, 510/503

See application file for complete search history.

(56) References Cited

U.S. PATENT DOCUMENTS

| | | | |
|---|---|---|---|
| 3,785,841 | A | 1/1974 | Beard |
| 4,517,023 | A | 5/1985 | Barabas |
| H468 | H | 5/1988 | Malik et al. |
| 4,935,065 | A | 6/1990 | Bull |
| 5,215,676 | A | 6/1993 | Stone |
| 5,279,799 | A | 1/1994 | Moser |
| 5,342,450 | A | 8/1994 | Cockrell, Jr. et al. |
| 5,489,666 | A | 2/1996 | Carey et al. |
| 5,647,995 | A | 7/1997 | Kneller et al. |
| 5,665,688 | A | 9/1997 | Honda et al. |
| 5,767,056 | A | 6/1998 | Lenoir |
| 5,786,320 | A | 7/1998 | Urfer et al. |
| 5,837,667 | A | 11/1998 | Stabley |
| 5,849,095 | A | 12/1998 | Rouillard |
| 5,858,305 | A | 1/1999 | Malchesky |
| 5,929,008 | A | 7/1999 | Goldstein |
| 6,034,046 | A | 3/2000 | Blanvalet et al. |
| 6,172,021 | B1 | 1/2001 | Ofosu-Asante et al. |
| 6,210,600 | B1 | 4/2001 | Zhou et al. |
| 6,232,280 | B1 | 5/2001 | Shah et al. |
| 6,247,478 | B1 | 6/2001 | Cords et al. |
| 6,248,704 | B1 | 6/2001 | Small et al. |
| 6,274,541 | B1 | 8/2001 | Man |
| 6,333,299 | B1 | 12/2001 | Pace et al. |
| 6,479,453 | B2 | 11/2002 | Man |
| 6,537,960 | B1 | 3/2003 | Ruhr et al. |
| 6,541,442 | B1 | 4/2003 | Johansson et al. |

(Continued)

FOREIGN PATENT DOCUMENTS

| | | |
|---|---|---|
| EP | 0 478 445 | 9/1991 |
| EP | 2 028 262 | 2/2009 |
| EP | 2 095 714 | 9/2009 |
| EP | 2 119 765 | 11/2009 |
| EP | 2 128 707 | 12/2009 |
| EP | 2 133 408 | 12/2009 |
| EP | 2 138 561 | 12/2009 |
| JP | 05279700 | 10/1993 |
| JP | 08012944 | 1/1996 |
| JP | 09118900 | 5/1997 |

(Continued)

OTHER PUBLICATIONS

"Hydrotropes", SIDS Initial Assessment Report, p. 1-349, Oct. 2005.*

(Continued)

*Primary Examiner* — Gregory R Delcotto

(74) *Attorney, Agent, or Firm* — Hudak, Shunk & Farine Co. LPA

(57) ABSTRACT

A biodegradable concentrated neutral detergent composition comprises various chelate compounds, various corrosion inhibitors, an alkaline compound, at least one sequestrant, various surfactants and hydrotropes, and water. The detergent can be highly concentrated, has a good long term shelf life, and when diluted is very effective in cleaning metals such as surgical instruments and prevents corrosion resistance of the metal even in a hard water environment.

22 Claims, No Drawings

(56) References Cited

U.S. PATENT DOCUMENTS

| | | | | |
|---|---|---|---|---|
| 6,551,985 | B1 | 4/2003 | Bianchetti et al. | |
| 6,581,613 | B2 | 6/2003 | Berkels et al. | |
| 6,632,291 | B2 | 10/2003 | Rabon et al. | |
| 6,686,325 | B2 | 2/2004 | Hoyt et al. | |
| 6,750,188 | B2 | 6/2004 | Baker et al. | |
| 6,840,251 | B2 | 1/2005 | Gill et al. | |
| 6,846,793 | B1 | 1/2005 | Griese | |
| 7,022,608 | B2 | 4/2006 | Sun et al. | |
| 7,037,884 | B2 | 5/2006 | Man | |
| 7,135,448 | B2 | 11/2006 | Lentsch et al. | |
| 7,144,513 | B2 | 12/2006 | Sher et al. | |
| 7,196,044 | B2 | 3/2007 | Smith et al. | |
| 7,196,045 | B2 | 3/2007 | Lentsch et al. | |
| 7,252,096 | B2 | 8/2007 | Gill et al. | |
| 7,424,891 | B2 | 9/2008 | Gentschev et al. | |
| 7,452,853 | B2 * | 11/2008 | Smith et al. | 510/225 |
| 7,456,140 | B2 | 11/2008 | Small et al. | |
| 7,524,803 | B2 | 4/2009 | Lentsch et al. | |
| 7,597,766 | B2 | 10/2009 | McRae et al. | |
| 7,638,473 | B2 * | 12/2009 | Smith et al. | 510/225 |
| 7,642,224 | B2 | 1/2010 | McRae et al. | |
| 7,648,583 | B2 | 1/2010 | McRae et al. | |
| 7,838,485 | B2 | 11/2010 | Heisig | |
| 7,902,137 | B2 | 3/2011 | Kneipp et al. | |
| 2001/0014656 | A1 | 8/2001 | Smith et al. | |
| 2003/0045439 | A1 * | 3/2003 | Evers | 510/238 |
| 2003/0151022 | A1 | 8/2003 | Bragulla et al. | |
| 2004/0102344 | A1 | 5/2004 | Nakayama et al. | |
| 2004/0244969 | A1 | 12/2004 | Kotlar et al. | |
| 2005/0003979 | A1 | 1/2005 | Lentsch et al. | |
| 2005/0020464 | A1 | 1/2005 | Smith et al. | |
| 2005/0239673 | A1 | 10/2005 | Hsu | |
| 2005/0247637 | A1 | 11/2005 | Sher et al. | |
| 2005/0277564 | A1 | 12/2005 | Heise et al. | |
| 2006/0069005 | A1 | 3/2006 | Song | |
| 2006/0100122 | A1 | 5/2006 | Baars et al. | |
| 2006/0128602 | A1 | 6/2006 | Lentsch et al. | |
| 2006/0159730 | A1 | 7/2006 | Simon | |
| 2006/0270580 | A1 | 11/2006 | Smith et al. | |
| 2007/0149431 | A1 | 6/2007 | Lentsch et al. | |
| 2007/0238631 | A1 | 10/2007 | Gambogi et al. | |
| 2008/0108539 | A1 | 5/2008 | Kany et al. | |
| 2008/0169102 | A1 | 7/2008 | Carbajal et al. | |
| 2008/0221006 | A1 | 9/2008 | Heisig et al. | |
| 2008/0234162 | A1 | 9/2008 | Rovito et al. | |
| 2009/0032058 | A1 | 2/2009 | McRae et al. | |
| 2009/0038649 | A1 | 2/2009 | Smith et al. | |
| 2009/0044845 | A1 | 2/2009 | Cui | |
| 2009/0120457 | A1 | 5/2009 | Naghshineh et al. | |
| 2009/0298738 | A1 | 12/2009 | Kneipp et al. | |
| 2010/0041577 | A1 | 2/2010 | Tippetts et al. | |
| 2010/0056414 | A1 | 3/2010 | Smith et al. | |

FOREIGN PATENT DOCUMENTS

| | | |
|---|---|---|
| JP | 2002-102886 | 4/2002 |
| WO | WO 92/12637 | 8/1992 |
| WO | WO 92/19708 | 11/1992 |
| WO | WO 95/15984 | 7/1995 |
| WO | WO 97/43392 | 11/1997 |
| WO | WO 98/05742 | 2/1998 |
| WO | WO 98/05749 | 2/1998 |
| WO | WO 01/00760 | 1/2001 |
| WO | WO 02/47819 | 6/2002 |
| WO | WO 2005/005589 | 1/2005 |
| WO | WO 2005/042658 | 5/2005 |
| WO | WO 2006/011934 | 2/2006 |
| WO | WO 2006/121580 | 11/2006 |
| WO | WO 2008/057380 | 5/2008 |
| WO | WO/2008/084227 | 7/2008 |
| WO | 2009020546 A1 | 2/2009 |
| WO | WO 2009/087541 | 7/2009 |
| WO | 2009125335 A2 | 10/2009 |
| WO | WO 2009/125335 | 10/2009 |
| WO | WO 2009/125336 | 10/2009 |

OTHER PUBLICATIONS

"Principles of Industrial Water Treatment," Drew Industrial Division, Ashland Chemical Company, Eleventh Edition 1994, pp. i, ii and 80-85.

Casiau. "Complexing Agents Between Science, Industry, Authorities and Users", Centro Stefano Fanscini Monte Vent. Ascona Switzerland [online], Mar. 11-16, 2007.

* cited by examiner

BIODEGRADABLE CONCENTRATED NEUTRAL DETERGENT COMPOSITION

CROSS-REFERENCE

This application claims the priority filing date of U.S. Provisional Application Ser. No. 61/400,175 filed Jul. 23, 2010, herein fully incorporated by reference.

FIELD OF THE INVENTION

The invention relates to a biodegradable concentrated neutral liquid detergent composition that is very effective in cleaning metals, preventing discoloration or staining thereof, and protecting them from corrosion. The detergent composition is free of silicates and is well suited for soft metals such as copper, aluminum, or brass which are more difficult to clean and protect than harder metals such as iron and steel. The concentrated composition comprises a proper selection of ingredients and selective amounts thereof including various classes of biodegradable compounds such as chelants, corrosion inhibitors, sequestrants, hydrotropes, and surfactants.

BACKGROUND OF THE INVENTION

Many surgical instrument cleaning chemistries contain corrosion inhibitor ingredients and chelating agents to help mitigate the damaging effects of water on surgical instrumentation and washing equipment.

Control of corrosion in surgical instruments and utensil processing is critical in maintaining the safe and effective operation of said devices. Many instruments and utensils contain soft metals such as copper, brass, aluminum and anodized aluminum. These soft metals are very susceptible to damage from both the detergents and the water in which they are processed. Typically neutral cleaning chemistries are used to process these metals. The neutral chemistries often contain silicate corrosion inhibitors that render them unusable for specific applications. They can also contain non-environmentally friendly corrosion inhibitors that create disposal concerns.

Heretofore, scale control has been achieved by using either a chelant or a scale inhibitor. Chelants such as EDTA (ethylene diamine tetraacetic acid), NTA (nitrilotriacetic acid), phosphates, and phosphonates inhibit calcium and magnesium scale by chemically binding to the calcium or magnesium ions in a one to one molar ratio. EDTA, NTA, and many other traditional chelants and scale inhibitors are not environmentally friendly. Additionally, the usage levels in concentrated detergents are generally 10% or greater, increasing their negative impact. Scale inhibitors such as polyacrylic acid inhibit the crystal structure of calcium carbonate, preventing the calcium carbonate salts from aggregating into particles large enough to precipitate.

U.S. Pat. No. 6,846,793 relates to compositions of the invention include: a surfactant having an HLB value from 1 to 10; and a compound of formula (I):

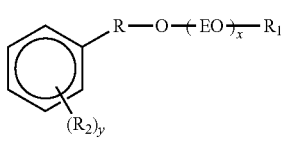

where; x is an integer from 2 to 6, y is an integer from 0 to 5, R is a bond or $(C_1-C_4)$alkylene, $R_1$ is a hydrogen, halo, aryl, $(C_1-C_4)$alkyl, heteroaryl, cycloalkyl, or heterocycyl, and $R_2$ is independently selected from hydrogen, halo, $(C_1-C_4)$alkyl, $(C_1-C_4)$alkoxy, $(C_2-C_4)$alkenylene.

U.S. Pat. No. 6,686,325 relates to an alkaline sensitive metal cleaning composition. The alkaline sensitive metal cleaning composition contains an alkaline concentrate and a corrosion inhibitor concentrate. The alkaline concentrate includes a source of alkalinity in an amount sufficient to provide a use solution having a pH of at least 10.0, and a first chelant component that exhibits soil removal properties when used at a pH of at least 10.0. The corrosion inhibitor concentrate includes a corrosion inhibitor component for reducing corrosion of alkaline sensitive metals when used in a use solution having a pH of at least 10.0, a second chelant component for stabilizing the corrosion inhibitor in the corrosion inhibitor concentrate when the corrosion inhibitor concentrate is provided at a pH that is less than 8.0, and a surfactant component for providing cleaning properties when used at a pH of at least 10.0.

U.S. Pat. Nos. 7,597,766, 7,642,224, and 7,648,583 relate to an aqueous, concentrated neutral detergent composition for use in cleaning medical instruments and metal components (parts, tools, utensils, vessels, equipment, and surfaces) having scale control and corrosion inhibition properties when diluted to about 1/40 ounce per gallon to about 1/10 ounce per gallon in potable water. In addition, the concentrate may be applied directly to metal surfaces, such as stainless steel, to remove rust and other stains, without causing any additional corrosion or other damage to the metal surface.

U.S. Publication 2008/0108539 relates to corrosion inhibitor systems, in particular to cleaning and corrosion inhibiting compositions for surfaces of aluminum or colored metals and alloys thereof under alkaline conditions, especially in the food and pharmaceutical industries. The cleaning and corrosion inhibiting compositions comprise as a corrosion inhibitor at least one alkyleneoxy alkylphosphate di- or triester having the general formula as set forth therein.

U.S. Publication 2008/0221006 relates to an aqueous, alkaline cleaning composition comprising a source of alkalinity, a biodegradable surfactant system further comprising one or more surfactants, one or more hydrotropes, and a UV-analyzable surfactant, and a biodegradable chelating agent.

U.S. Publication 2009/0298738 relates to an alkaline concentrated detergent composition for use in cleaning hard surfaces, medical instruments and other metal components (parts, tools, utensils, vessels, equipment) having cleaning efficacy at much lower alkali content than traditional alkaline cleaners and enhanced scale control properties even when diluted to about 1/40 ounce per gallon to about 1/10 ounce per gallon in potable water and even in exceptionally hard water.

WO 2009/125335 relates to a substantially nonaqueous concentrated composition comprising an amine oxide surfactant, a water-soluble solvent, a source of alkalinity, a chelating agent and a hydrotrope wherein the concentrate composition is useful in preparing a water soluble solution. The composition may optionally include any one or combination of a nonionic surfactant, anionic surfactant, a corrosion inhibitor, dye, perfume, or preservative.

WO 2009/125336 relates to a substantially nonaqueous solid concentrated composition comprising an amine oxide surfactant, an alkali metal hydroxide, a secondary source of alkalinity, a chelating agent, a nonionic surfactant, and a hardening agent wherein the concentrated composition is useful in preparing an aqueous solution. The composition may optionally include any one or combination of an anionic surfactant, a corrosion inhibitor, dye, perfume, or preservative. The ultra-concentrated composition of the invention is suited for solid deliveries.

SUMMARY OF THE INVENTION

A biodegradable concentrated neutral liquid detergent composition is disclosed that is effective in cleaning metals such as surgical instruments and soft metals such as copper, aluminum, etc., and also protects against corrosion thereof. The detergent is very effective in hard water environments that contain high amounts of calcium and magnesium ions. Other advantages include exceptional stability such as good shelf life, and that the detergent composition is highly concentrated and can be highly diluted. The detergent composition generally comprises various selected amounts of different components such as various chelates, various corrosion inhibitors, an alkaline source, at least one sequestrant, at least one hydrotrope, and various surfactants to obtain the above indicated advantages.

In one aspect of the invention, a concentrated neutral detergent composition comprises: a surfactant system comprising one or more nonionic surfactants, an optional one or more hydrotropes; a hard water scale control system comprising one or more chelants, and optionally one or more sequestrants; a buffer system comprising one or more buffers; a corrosion inhibitor system comprising one or more corrosion inhibitors; and; water; said neutral detergent composition having a pH of from about 5.5 to about 8.5.

A further aspect of the invention comprises a process for making a biodegradable concentrated neutral detergent composition comprising the steps of: adding and mixing one or more chelants; one or more optional sequestrants; one or more corrosion inhibitors; one or more buffers to provide a pH of at least about 5.5; one or more nonionic surfactants including at least one hydrotrope; and water.

DETAILED DESCRIPTION OF THE INVENTION

The biodegradable neutral detergent compositions of the present invention are effective in hard water in that they prevent scale formation by utilizing a scale control system comprising chelants and optional sequestrants. Chelants are a type of a coordination compound in which a central metal ion such as calcium or magnesium is attached by coordinate links to two or more non-metal atoms in the same molecule, called ligands. By combining with the calcium or magnesium cations, they prevent the same from interacting with carbonate anions and thus prevent scale formation. They also prevent metals such as zinc, iron, or copper from depositing on a metal substrate where they can cause staining or corrosion.

As utilized throughout this entire disclosure, the term "active amount" means the amount of the specified chemical component such as the chelant, the corrosion inhibitor, or the surfactant per se. The remaining amount in the component will be the carrier that can either be an oil, a water, or some other diluent. Thus, the 100 wt. % of the biodegradable concentrated neutral detergent composition of the present invention contains the various components, e.g. chelants, and corrosion inhibitors per se., with the remaining being an amount of water any carrier of the various components to form the 100 wt. % composition.

Suitable chelant systems generally include organic acids such as methyl glycine diacetic acid or a salt thereof such as trisodium methyl glycine diacetate (Trilon M), iminodisuccinic acid or a salt thereof such as tetrasodium iminodisuccinate (Baypure CX 100/34 or Baypure CX100 Solid G), and [S,S]-ethylenediamine-N,N'-disuccinic acid (Natrlquest A65 or Natrlquest E30). Desirably, a blend of two or more chelants are utilized in the present invention such as tetrasodium iminodisuccinate and trisodium methyl glycine diacetate. The total active amount of the one or more chelants utilized is from about 0.5 to about 7 wt. % or about 9 wt. %, desirably from about 1.0 to about 5 wt. %, and preferably from about 1.5 to about 3 wt. % based upon the total weight of the concentrated neutral detergent composition.

A preferred chelant system contains trisodium methyl glycine diacetate, and other similar chelants, in active amounts of from about 0.20 to about 3 wt. %, desirably from about 0.4 to about 2 wt. %, and preferably from about 0.6 to about 1.6 wt. % whereas tetrasodium iminodisuccinate and other similar chelants are contained in an active amount of from about 0.2 to about 4 wt. %, desirably from about 0.4 to about 3 wt. %, and preferably from about 0.7 to about 1.5 wt. % based upon the total weight of the biodegradable concentrated neutral detergent composition. These chelants have been found to be very stable in neutral solutions, are biodegradable, and are readily soluble in water.

The utilization of one or more optional sequestrants also serve to prevent scale formation caused by hard water. The sequestrants are highly effective scale as well as corrosion inhibitors and thus generally far less than stoichiometric concentrations are needed to control scale formation, even in highly-saturated hard water. Rather than to prevent the formation of calcium or magnesium carbonate, they interact with small calcium and magnesium carbonate particles and prevent them from aggregating into a hard scale deposit. The particles repel each other and remain suspended in water or form loose aggregates that settle and can be readily rinsed away. Effective amounts of one or more active sequestrants are from about 0.1 to about 3 or about 5 wt. % or about 6 wt. %, desirably from about 0.2 to about 2 wt. %, and preferably from about 0.25 to about 1 wt. % based upon the total weight of the biodegradable concentrated neutral detergent composition. Suitable sequestrants include aminotrimethylene phosphonic acid, hexamethylenediaminetetra(methylenephosphonic acid) hexapotassium salt, and sodium carboxylmethyl inulin desirably with carboxylate substitution degrees (DS) of about 2.5. Not all sequestrants have been found to be useful in the present invention such as sodium polyaspartate (Baypure DS100), polyacrylic acid, GLDA (glutamic acid, N,N-diacetic acid, and tetrasodium salt (Dissolvine GL-45-S). That is, the present invention is essentially free of these compounds and if utilized, the amount thereof is very small, that is generally less than about 0.25 wt. % desirably less than 0.075 wt. % and preferably less than 0.05 wt. % based upon the total weight of the biodegradable concentrated neutral detergent composition.

An important aspect of the present invention is to utilize a corrosion inhibitor system containing one or more corrosion inhibitors to protect metals such as copper, brass, aluminum, and anodized aluminum that are susceptible to damage from detergents as well as water such as hard water. Corrosion inhibitors that generally protect copper and brass are generally nitrogen containing organic compounds such as amines, amidazoles, diazoles, triazoles, carboxylic acids, and betaines (e.g. octyl betaine). Examples of such compounds include azoles such as mercaptobenzothiazole, aromatic triazoles and their salts such as benzotriazole, tolyltriazole, and sodium tolyltriazole, undecanedioic acid (Irgacor DC 11), dodecanedioic acid (Irgacor DC 12), ethanol 2,2'-[[methyl-1H-benzotriazole-1-yl)methyl]imino]bis-(Irgamet 42), 6,6',6"-(1,3,5-triazine-2,4,6-triyltriimino)tris(hexanoic acid) (Irgacor L190), phosphonobutane tricarboxylic acid (Bayhibit AMR) and dodecyl dimethyl ammonium bicarbonate/carbonate (CarboShield 1000). Desired corrosion inhibitor systems include as one component either sodium tolyltriazole, sodium benzotriazole, or 2,2'-[[methyl-1H-benzotriazole-1-yl)methyl]imino]bis—generally for yellow metals (copper, brass, etc.) and as the other component generally for aluminum 6,6',6"-(1,3,5-triazine-2,4,6-triyltriimino)tris(hexanoic acid), or dodecyl dimethyl ammonium bicarbonate/carbonate. A highly preferred corrosion inhibitor combination of the present invention is 6,6',6"-(1,3,5-triazine-2,4,6-triyltriimino)tris(hexanoic acid), and sodium tolyltriazole, with phosphonobutane tricarboxylic acid.

The active amount of the one or more corrosion inhibitors is generally from about 0.1 or about 1.0 to about 1.3 wt. % or about 15 wt. %, desirably from about 0.1 or about 1.5 to about 10 wt. %, and preferably from about 0.2 or about 1.75 to about 5 wt. % based upon the total weight of the biodegradable concentrated neutral detergent composition. The active amount of the preferred sodium tolyltriazole is generally from about 0.1 to about 3 wt. %, desirably from about 0.15 to about 2 wt. %, and preferably from about 0.2 to about 0.8 wt. % based upon the total weight of the biodegradable concentrated neutral detergent composition. The active amount of the preferred melamine trishexonoic acid generally ranges from about 1.0 to about 8 wt. %, desirably from about 1.5 to about 5 wt. %, and preferably from about 1.75 to about 4.5 wt. % based upon the total weight of the biodegradable concentrated neutral detergent composition.

Another important aspect of the present invention is to utilize a buffer system to maintain the desired neutral pH of the concentrated detergent composition. A proper pH is important with regard to the physical stability and compatibility of the detergent composition with various metals. Suitable buffer compounds include alkaline or amine sources that can also function to solubilize corrosion inhibitors such as melamine trishexanoic acid. Suitable buffers also include various alcohol amines such as ethanolamine or triethanolamine (TEA), and small amounts of hydroxides such as potassium hydroxide and sodium hydroxide. Other suitable buffers include organic acids such as citric acid, glycolic acid, or lactic acid. An effective amount of the buffer is utilized to maintain a neutral pH, e.g. from about 5.5 to about 8.5 and preferably from about 6 to about 8. Suitable active amounts of the one or more buffers will vary with the type of the compound but generally range from about 0.5 to about 6 wt. % or about 8 wt. %, desirably from about 1 to about 4.5 wt. %, and preferably from about 1.5 to about 3 wt. % based upon the total weight of the biodegradable concentrated neutral detergent composition. Strong acids such as sulfuric acid and nitric acid are avoided because they can create unwanted effects on metallic instrument surfaces. Thus, the present invention is generally free of such acids meaning that if they are utilized, the amount thereof is generally less than 1 wt. %, desirably less than about 0.5 wt. %, and preferably nil, that is none.

Hard water refers to water that contains high amounts of mineral therein such as calcium and magnesium ions, silica compounds, iron, and other minerals. "Hard" water is defined herein as water that contains about 120 ppm or greater of $CaCO_3$ and "exceptionally hard" water means that it contains about 300 ppm or greater of $CaCO_3$. Hard water is undesirable since it results in scale, that is a hard, adherent mineral composition such as calcium, magnesium, etc, that generally exists in a crystalline form and forms a deposit on metal. It has been found that the hard water scale control system of chelants and sequestrants of the present invention effectively control hard water scale formation when used at dilution ratios of about 0.125 ounce to about 0.5 ounce of the concentrated neutral detergent composition per gallon of water. It has been found that the utilization of both the chelant and sequestrant components can yield a synergistic result that prevents hard water scale formation to a greater degree than would be possible using only one or the other component, especially at neutral pH as chelants and sequestrants are typically more effective at higher pH. Other end use dilution amounts range from about 0.1 oz to about 2.0 oz, and desirably from about 0.11 oz to about 1.0 oz of concentrated neutral detergent composition per gallon of water.

The remainder of the biodegradable concentrated neutral detergent composition is essentially various surfactants. Nonionic, anionic, and amphoteric surfactant systems can be utilized with nonionic surfactants being preferred. Since nonionic surfactants may require a coupler to remain in solution with the electrolyte levels associated with the chelants, sequestrants, corrosion inhibitors, and buffers, hydrotropes such as amine oxides, proprionates, and glucosides, are often utilized.

Generally, a large number of different combinations of the various surfactants can be utilized in the present invention to help with soil removal as well as aiding in solubilization of the various chelants, corrosion inhibitors, sequestrants, and alkaline sources. Generally, the total amount of the one or more and preferably a plurality of surfactants ranges from about 1 to about 25 wt. % or about 30 wt. %, desirably from about 2 to about 15 wt. %, and preferably from about 7 to about 12 wt. %, based upon the total weight of the biodegradable concentrated neutral detergent composition.

Types of nonionic surfactants that are generally known to the art and to the literature include various linear ethoxylates such as primary or secondary alcohol ethoxylates, other alcohol alkoxylates, aromatic ethoxylates, modified ethoxylates, and blends thereof. Preferable examples include but are not limited to, $C_8$-$C_{18}$ alcohol ethoxylates with less than 12 moles of ethylene oxide (EO). Typical examples are commercially available under the trade names: Triton DF 20, Triton X114, Tergitol 15-S-3, Tergitol 15-S-5, Tomadol 91-2.5, Tomadol 91-8, Tomadol 1-3, Berol 508, Berol 505, Berol 260, Berol 840, Berol DGR81, Berol LFG61, Ethylan HB4, Neodol 91-2.5, Neodol 91-5, Neodol 1-2.5, Neodol 1-5, Deionic LF-EP-25, and DeTerge CS45LF, and Mackam BW 139, an octyl betaine. Tergitols and Tritons are commercially available from Dow; Berols and Ethylans are commercially available from Akzo Nobel, see U.S. Pat. No. 6,846,793 hereby fully incorporated by reference, Neodols are commercially available from Shell Chemical Company; and Delonics and DeTerges are commercially available from DeForest Chemical Company. Surfactants useful in the invention must be biodegradable. Preferred nonionic surfactants include Berol 505, a primary alcohol ethoxylate, and Berol LFG61, a blend of alcohol ethoxylate and alkylglucoside, both of which provide good wetting, detergency, and low, unstable foam characteristics. The most preferred nonionic surfactants include Tomadol 91-8, a linear primary alcohol ethoxylate with 8 moles of ethoxylation, and Ethlyan HB4, an aromatic ethoxylate. Both of these provide excellent wetting and soil emulsification/solublization (particularly fat) and have low, unstable foam characteristics. The above one or more nonionic linear or aromatic ethoxylate types of surfactants, independently, can be utilized in amounts of from about 1 to about 12 wt. %, desirably from about 2 to about 10 wt. %, and preferably from about 3 to about 7 wt. % based upon the total weight of the biodegradable concentrated neutral detergent composition.

Highly desired nonionic surfactants also include biodegradable block polymers of propylene oxide and ethylene oxide. An example of a preferred block copolymer is Meroxapol 252 or Tergitol L-64. These block copolymers are generally biodegradable, and provide good oil emulsification and defoaming. The amount of these types of nonionic block copolymers, independently, is generally from about 0.25 to about 4 wt %, desirably from about 0.4 to about 3 wt. %, and desirably from about 0.6 to about 2 wt. % based upon the total weight of the biodegradable concentrated neutral detergent composition.

Another important component of the overall surfactant system is the optional, but desirable, utilization of a coupler or hydrotrope. Examples of such hydrotropes are octyldimethylamine oxide, disodium 2-ethylhexyliminoproprionate, and alkylpolyglucosides. The amount of one or more hydrotropes, independently, is generally from about 0.5 to about 6 wt. %, desirably from about 0.5 to about 5 wt. % and preferably from about 1.0 to about 4 wt. % based upon the total weight of the biodegradable concentrated neutral detergent composition.

The biodegradable concentrated neutral detergent compositions of the present invention have been found to provide unexpected results with regard to the physical stability of the composition, cleaning of various metals, and providing corrosion protection, even in hard water environments so that scale formation is prevented. Compositions have been found particularly suitable for application to soft metals, i.e. articles containing copper, brass, aluminum, and aluminum alloys. Particular uses of the compositions of the present invention include cleaning medical and surgical instruments as well as washing equipment therefor.

An important component of the biodegradable concentrated neutral detergent composition of the present invention is water which is utilized in amounts so that the various weight percents of the composition add up to 100%. While the amount of water can broadly range from about 46 to about 94 wt. %, it generally ranges from about 60 to about 90 wt. % and desirably from about 70 to about 85 wt. % based upon the total amount of the biodegradable concentrated neutral detergent composition. The water is deionized or soft water meaning it contains less than about 50 ppm of hardness (calcium and magnesium).

The concentrated neutral detergent composition can also contain various additives in various amounts that are in addition to the above-noted amounts, i.e. 100 wt. % of the biodegradable concentrated neutral detergent composition. Examples of such additives include preservatives, fragrances, or dyes. The amounts of such additives are generally small, such as from about 0.01 to about 1 or about 3 parts by weight based upon 100 total parts by weight of the neutral detergent composition. Examples of additives include iodopropynyl butyl carbamate, a fungicide, and DMDM hydantoin, a preservative.

An important aspect of the present invention is that the biodegradable concentrated neutral detergent compositions of the present invention are essentially free of various non-biodegradable corrosion inhibitors such as silicates, phosphates, molybdates, as well as magnesium and zinc metals or ions that are often utilized as corrosion inhibitors that render them unsuitable for specific applications such as cleaning ophthalmic instruments or in high temperature applications. Examples of corrosion inhibitors that are avoided include potassium silicate, trisodium phosphate, bimetallic phosphates, and zinc molybdate. By the term "essentially free of" is meant that the amount of any such silicates, phosphates, molybdates, magnesium and zinc inhibitors, individually, is generally less than about 3 parts by weight, desirably less than about 1 part by weight and preferably less than 0.003 parts by weight or no parts by weight for every 100 parts by weight of the concentrated neutral detergent composition.

Other compounds that are avoided by the present invention include various silicone surfactants used as defoamers such as dimethylpolysiloxane, and the like. That is, the present invention is essentially free thereof meaning that any amount used is generally less than about 3 parts by weight, desirably less than about 1 part by weight, and preferably no parts by weight of such silicone surfactants for every 100 parts by weight of the biodegradable concentrated neutral detergent composition of the present invention.

The invention would be better understood by reference to the following examples which serve to illustrate but not to limit the invention.

While the order of adding the various components and mixing can generally be in any order and typically does not impact the final product stability, a desired preparation of the biodegradable concentrated neutral detergent composition involves ensuring that any solid components are fully dissolved prior to the addition of the surfactant components.

Specific recipes or formulations of biodegradable concentrated neutral detergent compositions of the present invention are set forth in Table 1 in Examples A through J. The formulations are prepared in a manner as set forth hereinabove and are tested with regard to aluminum compatibility and scale control. Values of percent calcium above 50% at ⅛ ounce of concentrated detergent composition of the present invention diluted in one gallon of water is considered to be very good.

TABLE 1

| Trade Name | Material | Function | A | B | C | D | E |
|---|---|---|---|---|---|---|---|
| Triethanolamine (99% Active) | Triethanolamine | Buffer | 2.250% | 2.000% | 2.400% | 2.000% | 2.360% |
| Irgacor L 190 (50% Active) | 6,6',6''-(1,3,5-Triazine-2,4,6-triyltriimino)tris(hexanoic acid) | Corosion Inhibitor | 5.000% (2.500%) | 5.000% (2.500%) | 4.500% (2.250%) | 4.500% (2.250%) | 4.500% (2.250%) |
| Cobratec TT-50S (50% Active) | Sodium Tolyltriazole | Corrosion Inhibitor | 0.500% (0.250%) | 0.500% (0.250%) | 0.500% (0.250%) | 0.500% (0.250%) | 0.500% (0.250%) |
| Baypure CX 100 (78% Active) | Tetrasodium Iminodisuccinate | Chelant | 1.000% (0.780%) | 1.500% (1.170%) | 1.560% (1.217%) | 1.560% (1.217%) | 1.560% (1.217%) |
| Trilon M (40% Active) | Methyglycine Diacetic acid, trisodium salt | Chelant | 1.500% (0.600%) | 2.000% (0.800%) | 2.000% (0.800%) | 2.000% (0.800%) | 2.000% (0.800%) |
| Irgamet 42 (78% Active) | Ethanol, 2,2'-[[(methyl-1H-benzotriazole-1-yl)methyl]imino]bis- | Corrosion Inhibitor | | | | | |
| Glycacil-L (10% Active) | Iodopropynylbutylcarbamate (IPBC) | Preservative | | 0.050% | 0.050% | 0.050% | 0.050% |
| Dantoguard Plus | DMDM Hydantoin + IPBC | Preservative | | | | | |
| Bayhibit AM (50% Active) | Phosphonobutane tricarboxylic acid | Corrosion Inhibitor | 0.100% (0.050%) | 1.000% (0.500%) | 1.000% (0.500%) | 0.500% (0.250%) | 1.000% (0.500%) |

TABLE 1-continued

| | | | | | | | |
|---|---|---|---|---|---|---|---|
| Citric Acid (100% Active) | Citric Acid | Buffer | | 0.300% | | 0.020% | |
| Dequest 2054 (35% Active) | Hexamethylenediamine tetra(methylene phosphonic acid) hexapotassium salt (HDTMP) | Sequestrant | | | | | |
| Dequest SPE 15625 (20% Active) | Sodium Carboxymethyl Inulin | Sequestrant | | | | | |
| Ethylan HB4 (100%) | Aromatic Ethoxylate | Nonionic Surfactant | 3.000% | | | | |
| Meroxapol 252 (100% Active) | Polyoxypropylene-polyoxyethylene Block Copolymer | Surfactant | 0.750% | 1.500% | | | 1.500% |
| Tergitol L-64 (100% Active) | Polyether polyol | Surfactant | 3.000% | | | | |
| Mackamine C-8 (40% Active) | Octyldimethylamine oxide | Hydrotrope | 3.000% | 3.000% | | | |
| Mackam BW 139 (50% Active) | Octyl Betaine | Surfactant | | | | | |
| Mackam ODP 45-M (45% Active) | Disodium 2-Ethylhexyliminodipropionate | Hydrotrope | | | | | |
| Rhodapon OLS (33% Active) | Sodium Octyl Sulfate | Surfactant | 4.000% | | | | |
| Tomadol 91-8 (100% Active) | C9-11 Pareth-8 | Surfactant | | 9.000% | | | 4.500% |
| Berol LFG 61 (95% Active) | Proprietary Alkyglycoside/ Alcohol Ethoxylate Blend | Hydrotrope/ Surfactant | | 5.000% | 10.000% | 10.000% | 3.500% |
| Berol 505 (100% Active) | Proprietary Alcohol Ethoxylates | Surfactant | | | | | |
| | Soft Water | | Q.S. | Q.S. | Q.S. | Q.S. | Q.S. |
| | OZ/Gal | | 1 oz | 1 oz | 1 oz | 1 oz | 1 oz |
| | Mpy's | | −0.06 | 0.18 | 0.30 | 0.18 | 0.24 |
| Aluminum Compatibility | Observations | | Slight Discolor | Slight Discolor | Slight Discolor | Slight Discolor | Slight Discolor |

| Trade Name | Material | F | G | H | I | J |
|---|---|---|---|---|---|---|
| Triethanolamine (99% Active) | Triethanolamine | 2.000% | 2.560% | 1.120% | 1.780% | 2.450% |
| Irgacor L 190 (50% Active) | 6,6',6''-(1,3,5-Triazine-2,4,6-triyltriimino)tris(hexanoic acid) | 4.500% (2.250%) | 4.500% (2.250%) | 4.000% (2.000%) | 4.000% (2.000%) | 4.500% (2.250%) |
| Cobratec TT-50S (50% Active) | Sodium Tolyltriazole | 0.500% (0.250%) | 0.500% (0.250%) | | | 0.500% (0.250%) |
| Baypure CX 100 (78% Active) | Tetrasodium Iminodisuccinate | 1.560% (1.217%) | 1.560% (1.217%) | | 3.000% (2.340%) | 1.560% (1.217%) |
| Trilon M (40% Active) | Methyglycine Diacetic acid, trisodium salt | 2.000% (0.800%) | 2.000% (0.800%) | 4.000% (1.600%) | | 2.000% (0.800%) |
| Irgamet 42 (78% Active) | Ethanol, 2,2'-[[(methyl-1H-benzotriazole-1-yl)methyl]imino]bis- | | | 2.000% (1.560%) | | |
| Glycacil-L (10% Active) | Iodopropynylbutylcarbamate (IPBC) | 0.050% | 0.050% | | | |
| Dantoguard Plus | DMDM Hydantoin + IPBC | | | | | 0.160% |
| Bayhibit AM (50% Active) | Phosphonobutane tricarboxylic acid | | 1.000% (0.500%) | | 0.500% (0.250%) | 1.000% (0.500%) |
| Citric Acid (100% Active) | Citric Acid | 0.200% | | 0.400% | | |
| Dequest 2054 (35% Active) | Hexamethylenediamine tetra(methylene phosphonic acid) hexapotassium salt (HDTMP) | 2.000% (0.700%) | | | | |
| Dequest SPE 15625 (20% Active) | Sodium Carboxymethyl Inulin | | | 1.000% (0.20%) | | |
| Ethylan HB4 (100%) | Aromatic Ethoxylate | | | | | 2.000% |
| Meroxapol 252 (100% Active) | Polyoxypropylene-polyoxyethylene Block Copolymer | | 0.200% | | | 1.000% |
| Tergitol L-64 (100% Active) | Polyether polyol | | | | | |
| Mackamine C-8 (40% Active) | Octyldimethylamine oxide | | 5.180% | | | 3.000% |
| Mackam BW 139 (50% Active) | Octyl Betaine | | | 5.000% | 3.000% | |
| Mackam ODP 45-M (45% Active) | Disodium 2-Ethylhexyliminodipropionate | | | 1.000% | 1.000% | |
| Rhodapon OLS (33% Active) | Sodium Octyl Sulfate | | | | | |

TABLE 1-continued

| | | | | | | |
|---|---|---|---|---|---|---|
| Tomadol 91-8 (100% Active) | C9-11 Pareth-8 | | | | | 3.000% |
| Berol LFG 61 (95% Active) | Proprietary Alkyglycoside/ Alcohol Ethoxylate Blend | 10.000% | | | | |
| Berol 505 (100% Active) | Proprietary Alcohol Ethoxylates | | 5.000% | | | |
| | Soft Water | Q.S. | Q.S. | Q.S. | Q.S. | Q.S. |
| | OZ/Gal | 1 oz | 1 oz | 1 oz | 1 oz | 1 oz |
| | Mpy's | 0.24 | −0.06 | 0.84 | 0.96 | 0.12 |
| Aluminum Compatibility | Observations | Dark Discolor | Dark Discolor | slight brown discolor | slight grayish-brown discolor | extremely slight discolor |

| Scale Control | Product | A | B | C | D | E | F | G | H | I | J |
|---|---|---|---|---|---|---|---|---|---|---|---|
| (% Calcium) | ½ oz | 97.82% | 100.00% | 100.00% | 99.51% | 100.00% | 96.64% | 100.00% | 100.00% | 100.00% | 100.00% |
| | ⅛ oz | 59.87% | 60.36% | 100.00% | 100.00% | 100.00% | 99.27% | 100.00% | 58.29% | 98.88% | 98.97% |

As apparent from the above data, generally only slight discoloration was obtained with regard to an aluminum substrate and the values of scale control are good, generally well in excess of 95% for most formulations. Another advantage of the present invention is that all the above formulations are readily biodegradable.

While in accordance with the patent statutes, the best mode and preferred embodiment have been set forth, the scope of the invention is not limited thereto, but rather by the scope of the attached claims.

What is claimed is:

1. A concentrated neutral detergent composition comprising:

one or more nonionic surfactants, comprising a primary or a secondary alcohol ethoxylate, an alcohol alkoxylate other than said ethoxylate, an aromatic ethoxylate, a modified ethoxylate, or a block polymer of propylene oxide and ethylene oxide, or any combination thereof, and wherein the amount of said nonionic surfactant is from about 1 to about 15 wt. % based upon the total weight of said concentrated neutral detergent composition;

from about 0.5 to about 6 wt. % based upon the total weight of said concentrated neutral detergent composition of one or more hydrotropes comprising an amine oxide, or a glucoside, or both;

from about 0.5 to about 9 wt. % based upon the total weight of said concentrated neutral detergent composition of one or more chelants;

a buffer comprising one or more alcohol amines, or one or more organic acids, or any combination thereof, wherein the amount of said one or more buffers is from about 0.5 to about 8 wt. % based upon the total weight of said concentrated neutral detergent composition;

from about 0.1 to about 15 wt. % based upon the total weight of said concentrated neutral detergent composition of one or more corrosion inhibitors comprising an amine, amidazole, diazole, triazole, carboxylic acid, or any combination thereof;

water; and said neutral detergent composition having a neutral pH of from about 5.5 to about 8.5; and said neutral detergent composition having physical stability and being capable of cleaning soft metals and preventing scale formation thereon.

2. The concentrated neutral detergent composition of claim 1, wherein said soft metal comprises copper, brass, aluminum, or an aluminum alloy, or any combination thereof.

3. The concentrated neutral detergent composition of claim 2, wherein said chelant comprises methyl glycine diacetic acid, trisodium methyl glycine diacetate, iminodisuccinic acid, tetrasodium iminodisuccinate, or [S,S]-ethylenediamine-N,N'-disuccinic acid, or any combination thereof; and wherein said hydrotrope comprises octyldimethylamine oxide, or an alkylglycoside, or any combination thereof.

4. The concentrated neutral detergent composition of claim 1, wherein said corrosion inhibitor comprises mercaptobenzothiazole, benzotriazole, tolyltriazole, sodium tolyltriazole, undecanedioic acid, phosphonobutane tricarboxylic acid, dodecanedioic acid, ethanol-2,2'-[[methyl-1H-benzotriazole-1-yl)methyl]imino]bis, melamine tris(hexanoic acid), dodecyl dimethyl ammonium bicarbonate/carbonate, or sodium benzotriazole, or any combination thereof, and wherein the amount of said one or more corrosion inhibitors is from about 0.1 wt. % to about 10 wt. % based upon the total weight of said concentrated neutral detergent composition.

5. The concentrated neutral detergent composition of claim 4, wherein said chelant comprises methyl glycine diacetic acid, trisodium methyl glycine diacetate, iminodisuccinic acid, or tetrasodium iminodisuccinate, or [S,S]-ethylenediamine-N,N'-disuccinic acid; wherein the amount of said chelant is from about 0.5 to about 5 wt. % based on the total weight of said concentrated neutral detergent composition; wherein said buffer comprises an alcohol amine, citric acid, glycolic acid, or lactic acid, or any combination thereof, and wherein said pH of said concentrated neutral detergent composition is from about 6.0 to about 8.0.

6. The concentrated neutral detergent composition of claim 5, wherein said hydrotrope comprises octyldimethylamine oxide, or an alkylglycoside, or any combination thereof, wherein the amount of said hydrotrope is from about 0.5 to about 6 wt. % based upon the total weight of concentrated neutral detergent composition, wherein said corrosion inhibitor is said sodium tolyltriazole in an amount of from 0.1 wt. % to about 3 wt. %, said melamine tris(hexanoic acid) in an amount of from about 1.0 to about 8 wt. %, or said phosphonobutane tricarboxylic acid in an amount of from about 0.1 wt. % to about 5 wt. % based upon the total weight of said concentrated neutral detergent composition; wherein said buffer is ethanolamine, triethanolamine, citric acid, or any combination thereof and wherein the amount of said buffer is from about 0.5 to about 4.5 wt. % based on the total weight of said concentrated neutral detergent composition; wherein said nonionic surfactant is said primary alcohol ethoxylate, said aromatic ethoxylate, or said block copolymer of propylene oxide and ethylene oxide, or any combination thereof.

7. The concentrated neutral detergent composition of claim 3, wherein said corrosion inhibitor comprises phosphonobutane tricarboxylic acid compound.

8. The concentrated neutral detergent composition of claim 1, wherein said composition is biodegradable.

9. The concentrated neutral detergent composition of claim 2, wherein said composition is biodegradable.

10. The concentrated neutral detergent composition of claim 4, wherein said composition is biodegradable.

11. The concentrated neutral detergent composition of claim 7, wherein said composition is biodegradable.

12. The concentrated neutral detergent composition of claim 5, that is essentially free of a silicate, a phosphate, a molybdate, magnesium metal or ions, or zinc metal or ions, or any combination thereof.

13. A process for making a neutral detergent composition comprising the steps of:

adding, mixing, and forming a biodegradable concentrated neutral detergent comprising:

from about 0.5 to about 9 wt. % based upon the total weight of said concentrated neutral detergent composition of one or more chelants;

from about 0.1 to about 15 wt. % based upon the total weight of said concentrated neutral detergent composition of one or more corrosion inhibitors comprising an amine, amidazole, diazole, triazole, carboxylic acid, or any combination thereof;

one or more buffers comprising one or more alcohol amines or one or more organic acids, or any combination thereof, in an amount of from about 0.5 to about 8 wt. % based upon the total weight of said concentrated neutral detergent composition;

one or more nonionic surfactants comprising a primary or a secondary alcohol ethoxylate, an alcohol alkoxylate other than said ethoxylate, an aromatic ethoxylate, a modified ethoxylate, or a block polymer of propylene oxide and ethylene oxide, or any combination thereof, and wherein the amount of said nonionic surfactant is from about 1 to about 15 wt. % based upon the total weight of said concentrated neutral detergent composition;

from about 0.5 to about 6 wt. % based upon the total weight of said concentrated neutral detergent composition of at least one hydrotrope comprising an amine oxide, or a glucoside, or both; and water;

wherein said concentrated neutral detergent composition has a pH of from about 5.5 to about 8.5 wt. % and being capable of cleaning soft metals and preventing scale formation thereon.

14. The process of claim 13, wherein said chelant comprises methyl glycine diacetic acid, trisodium methyl glycine diacetate, iminodisuccinic acid, tetrasodium iminodisuccinate, or [S,S]-ethylenediamine-N,N'-disuccinic acid, or any combination thereof.

15. The process of claim 14, wherein said corrosion inhibitor comprises mercaptobenzothiazole, benzotriazole, tolyltriazole, sodium tolyltriazole, undecanedioic acid, phosphonobutane tricarboxylic acid, dodecanedioic acid, ethanol-2, 2'-[[methyl-1H-benzotriazole-1-yl)methyl]imino]bis, melamine tris(hexanoic acid), dodecyl dimethyl ammonium bicarbonate/carbonate, or sodium benzotriazole, or any combination thereof, wherein the amount of said one or more corrosion inhibitors is from about 0.1 wt. % to about 10 wt. % based upon the total weight of said concentrated neutral detergent composition; wherein said chelant comprises trisodium methyl glycine diacetate, or tetrasodium iminodisuccinate, or both; wherein the amount of said chelant is from about 0.5 to about 5 wt. % based on the total weight of said concentrated neutral detergent composition; wherein said pH of said concentrated neutral detergent composition is from about 6 to about 8; and wherein said soft metal comprises copper, brass, aluminum, an aluminum alloy, or any combination thereof.

16. The process of claim 15, wherein said corrosion inhibitor comprises phosphonobutane tricarboxylic acid; wherein said buffer is ethanolamine, triethanolamine, citric acid, or any combination thereof; wherein the amount of said buffer is from about 0.5 to about 4.5 wt % based upon the total weight of said concentrated neutral detergent composition; wherein said nonionic surfactant is said primary alcohol ethoxylate, said aromatic ethoxylate, or said block copolymer of propylene oxide and ethylene oxide, or any combination thereof; wherein said hydrotrope comprises octyldimethylamine oxide, or an alkylglycoside, or any combination thereof, and wherein the amount of said hydrotrope is from about 0.5 to about 6 wt. % based upon the total weight of said concentrated neutral detergent composition.

17. The process of claim 14, comprising dissolving any solids in said composition before adding said one or more nonionic surfactants.

18. A diluted neutral detergent composition, comprising the composition of claim 1, and additional water.

19. A diluted neutral detergent composition, comprising from about 0.1 oz to about 2.0 oz of the composition of claim 3, per gallon of water.

20. A diluted neutral detergent composition, comprising from about 0.125 oz to about 0.5 oz of the composition of claim 6, per gallon of water.

21. A diluted neutral detergent composition, comprising from about 0.1 oz to about 2.0 oz of the composition of claim 10, per gallon of water.

22. A diluted neutral detergent composition, comprising from about 0.125 oz to about 0.5 oz of the composition of claim 12, per gallon of water.

* * * * *